US008526873B2

(12) United States Patent
Inaba

(10) Patent No.: US 8,526,873 B2
(45) Date of Patent: Sep. 3, 2013

(54) IMAGE FORMING APPARATUS AND THRESHOLD SETTING METHOD

(75) Inventor: Toshihide Inaba, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 285 days.

(21) Appl. No.: 12/929,602

(22) Filed: Feb. 3, 2011

(65) Prior Publication Data

US 2011/0211895 A1 Sep. 1, 2011

(30) Foreign Application Priority Data

Feb. 27, 2010 (JP) ..... 2010-043616

(51) Int. Cl.
*G03G 15/00* (2006.01)
*B65H 23/04* (2006.01)

(52) U.S. Cl.
USPC ..... 399/384; 399/394; 226/27

(58) Field of Classification Search
CPC ..... B41J 11/46
USPC ..... 399/301, 384, 394, 396; 347/116; 226/27; 250/559.44
See application file for complete search history.

(56) References Cited

U.S. PATENT DOCUMENTS 8,107,833 B2 * 1/2012 Yoshida ..... 399/44
2004/0179217 A1 * 9/2004 Chapman et al. ..... 358/1.12

FOREIGN PATENT DOCUMENTS

JP 2000318221 A 11/2000
JP 2002174936 A 6/2002
JP 2002207338 A 7/2002
JP 3680989 B2 5/2005
JP 4013139 B2 9/2007

OTHER PUBLICATIONS

Abstract of JP 2003-266825 published on Sep. 25, 2003.
Abstract of JP 2002-187660 published on Jul. 2, 2002.

* cited by examiner

*Primary Examiner* — Daniel J Colilla
*Assistant Examiner* — Blake A Tankersley
(74) *Attorney, Agent, or Firm* — Harness, Dickey & Pierce, P.L.C.

(57) ABSTRACT

A moving unit causes a relative movement of a web and a mark detecting unit for detecting a ground color of the web and a mark color in a predetermined direction. A measuring unit measures a measurement value corresponding to a moving amount of the mark detecting unit with respect to the web in a time from when a detected color is switched from the ground color to the mark color till when a detected color is back to the ground color. A setting unit sets a threshold used for determining whether the color detected is the ground color or the mark color on the basis of the mark color detected by the mark detecting unit at the time when the mark detecting unit is moved in a reverse direction for a distance of half the measurement value since the color detected is back to the ground color.

9 Claims, 7 Drawing Sheets

IMAGE FORMING APPARATUS AND THRESHOLD SETTING METHOD

CROSS-REFERENCE TO RELATED APPLICATIONS

The present application claims priority to and incorporates by reference the entire contents of Japanese Patent Application No. 2010-043616 filed in Japan on Feb. 27, 2010.

BACKGROUND OF THE INVENTION

1. Field of the Invention

The present invention generally relates to an image forming apparatus, and a threshold setting method.

2. Description of the Related Art

As a printing system for forming images on both sides of a web without a feed hole as typified by a continuous long belt-like sheet, for example, as described in Japanese Patent No. 3680989, a printing system capable of printing an image on the second side of a web correctly so as to align with an image on the first side even if the web discharged from a first printing device is shrunk or expanded with environment has been proposed and put to practical use.

FIG. 1 shows a total configuration of an electrophotographic device applied to a conventional printing system. In FIG. 1, "W" denotes a web; usually, it is a paper web in most cases. The web W delivered from a feeding device (not shown) is fed toward a web buffer mechanism 2 by being guided by a guide roller 1 arranged on a feed path to thread through a printing device P. Then, the web W passes through a guide member 3, a foreign-body removing mechanism 4, a tension applying mechanism 5, a guide shaft 6, and a guide plate 7, and is fed into an imaging unit 10 by feed rollers 8 and 9. In the imaging unit 10, through charging, exposure, and developing processes, a toner image is formed on a photosensitive drum 101, and after that, the toner image is transferred onto the web W by the action of a transfer unit 105.

The web W gets off a feed belt 11, and is fed to a fixing unit 13 via a buffer plate 12. When reaching the fixing unit 13, the web W is preheated by a preheater 13*a*. After that, the web W is fed while being sandwiched in a nip between a pair of fixing rollers composed of a heat roller 13*b* and a pressure roller 13*c*, and applied with heat and pressure by the heat roller 13*b* and the pressure roller 13*c* thereby fusing and fixing the toner image on the web W.

Furthermore, a reference numeral 16 denotes a mark detecting unit (a mark sensor) for detecting a positioning mark 17 formed on the web W as shown in FIG. 2. The mark sensor 16 is an optical sensor composed of a light-emitting element and a light-sensitive element. The positioning mark 17 is formed on near the top of each page, and is used as a reference position for aligning positions of images that are formed on both sides of the web W by first and second printing devices which are connected to each other. Specifically, the second printing device detects the positioning mark 17 formed by the first printing device, and prints out an image on the second side of the web W correctly so as to align with an image on the first side by controlling, i.e., changing the rotating speeds of the feed rollers 8 and 9 and the photosensitive drum 101 (for example, see Japanese Patent No. 3680989 and Japanese Patent Application Laid-open No. 2003-266825).

Conventionally, in such a printing system, when an image is printed to fit in a business form of a preprinted sheet, the first printing device needs to form the positioning mark 17 on the preprinted sheet. However, to bother to form the positioning mark 17 on the preprinted sheet in addition to the business form causes an extra cost; therefore, recently, a method to use a portion of the business form, such as a company name or logo printed at the specified position on each page, as a positioning mark has been implemented.

A company name or logo on a preprinted sheet differs in layout or a color from one business form to another, so it is necessary to provide a way to detect a plurality of colors at an arbitrary position; therefore, by providing a mechanism capable of moving the mark detecting unit to an arbitrary position in a main-scanning direction or by making a sensitivity adjustment in accordance with a color of the company name or logo using an optical sensor with sensitivity to the plurality of colors, the company name or logo can be used as a positioning mark.

On the other hand, as a method for the sensitivity adjustment, there is a method to cause the mark sensor 16 to recognize a color of the positioning mark 17 and a ground color of the web W and set an intermediate color of the two colors as a threshold. At this time, it is preferable to arrange the positioning mark 17 in the center of a detectable area of the mark sensor 16. As a method to detect the center of the positioning mark 17, for example, as proposed in Japanese Patent Application Laid-open No. 2002-207338 and Japanese Patent Application Laid-open No. 2002-174936, there is a detection method in which using a sensor that outputs 0 V when the mark sensor 16 detects the positioning mark 17 and 5 V when the mark sensor 16 does not detect the positioning mark 17, the position of the center of a line connecting the center voltage in a fall region of an analog signal output from the sensor and the center voltage in a subsequent rise region is set as the center of the positioning mark 17.

Furthermore, Japanese Patent Application Laid-open No. 2000-318221 has proposed a detection method in which using the mark sensor 16 that outputs an analog voltage according to a color of an object to be detected, a voltage between a voltage value$\pm\alpha$ that is output when detecting the ground color of the web W, and a peak voltage value that is output when detecting the positioning mark 17 is set as a threshold voltage. Two points at which an output voltage of the mark sensor 16 intersects with the threshold voltage near the peak voltage are obtained, and then the midpoint of the two points is set as the center of the positioning mark 17.

Moreover, as a simplified method, there is known a method that a scale 18 as shown in FIG. 8 is provided, and an operator visually sets the positioning mark 17 so that the positioning mark 17 is positioned roughly in the center of a detectable area $\phi$ of the mark sensor 16.

The mark sensor 16 is a sensor that the light-sensitive element detects that a light emitted from the light-emitting element is reflected or absorbed on the basis of a color of a target object, and recognizes a color level of the target object according to an amount of light received. Therefore, when the ground color of the web W and the positioning mark 17 are both contained within the detectable area $\phi$, an amount of light received, i.e., a color level varies according to the proportion of the positioning mark 17 in the detectable area $\phi$.

Consequently, when the visual position adjustment is made, even though an operator believes that the positioning mark 17 is positioned in the center of the detectable area $\phi$ of the mark sensor 16, the positioning mark 17 may deviate from the detectable area $\phi$, or the position of the positioning mark 17 varies among operators, and therefore, a result of the sensitivity adjustment varies.

FIG. 9A is a diagram illustrating a case in which the positioning mark 17 is positioned in the center of the detectable area $\phi$ of the mark sensor 16; FIG. 9B is a diagram illustrating a case in which the positioning mark 17 is not positioned in the center of the detectable area ϕ of the mark sensor 16. FIG. 10 is a diagram showing color levels of the ground color of the web W and the positioning mark 17 recognized by the mark sensor 16 and a threshold level in the cases shown in FIGS. 9A and 9B.

With respect to an object of which the size is larger than the detectable area ϕ like the web W, it is easy to make a position adjustment, so a variation in color recognized by the mark sensor 16 is small. Namely, L0≈L0' holds. On the other hand, when an object is small in size like the positioning mark 17, it is difficult to arrange the object to fit perfectly in the detectable area ϕ of the mark sensor 16. When a sensitivity adjustment is made in a state where the positioning mark 17 deviates from the detectable area ϕ as shown in FIG. 9B, a color level L1' of the positioning mark 17 is in a relation of L1'>L1. Furthermore, when an exactly intermediate level of the color levels of the ground color of the web W and the positioning mark 17 is set as a threshold, a threshold level TH' is in a relation of TH'>TH.

In this manner, when a sensitivity adjustment is made in a state where the positioning mark 17 deviates from the detectable area ϕ, the mark sensor 16 recognizes the color of the positioning mark 17 as a color close to the ground color of the web W, so a contrast with the color of the web W is insufficient; therefore, if a disturbance, such as flapping of the web, is produced while the web is fed, there arises a problem in that the positioning mark 17 is incorrectly detected even though there is no positioning mark 17.

Furthermore, to arrange the positioning mark 17 in the center of the detectable area ϕ of the mark sensor 16 using any of the above-described methods disclosed in Japanese Patent Application Laid-open No. 2002-207338, Japanese Patent Application Laid-open No. 2002-174936, and Japanese Patent Application Laid-open No. 2000-318221, data processing, such as an analog-to-digital (A/D) conversion of an output signal of the mark sensor 16, is required and a circuit configuration becomes complex.

SUMMARY OF THE INVENTION

It is an object of the present invention to at least partially solve the problems in the conventional technology.

An image forming apparatus according to an aspect of the present invention that forms an image on a web with reference to a position of a positioning mark on the web, includes: a moving unit that causes a relative movement of the web and a mark detecting unit in a predetermined direction, the mark detecting unit detecting a ground color of the web and a mark color which is a color of the positioning mark; a measuring unit that measures a measurement value corresponding to a moving amount of the mark detecting unit with respect to the web in a time from when a color detected by the mark detecting unit is switched from the ground color to the mark color till when a color detected by the mark detecting unit is back to the ground color; and a setting unit that sets a threshold used for determining whether the color detected is the ground color or the mark color on the basis of the mark color, which is detected by the mark detecting unit at the time when the mark detecting unit is moved in a reverse direction for a distance of half the measurement value since the color detected is back to the ground color.

A threshold setting method according to another aspect of the present invention executed in an image forming apparatus for forming an image on a web with reference to a position of a positioning mark on the web, includes: causing, by a moving unit, a relative movement of the web and a mark detecting unit, which detects a ground color of the web and a mark color that is a color of the positioning mark, in a predetermined direction; measuring, by a measuring unit, a measurement value corresponding to a moving amount of the mark detecting unit with respect to the web in a time from when a color detected by the mark detecting unit is switched from the ground color to the mark color till when a color detected by the mark detecting unit is back to the ground color; and setting, by a setting unit, a threshold used for determining whether the color detected is the ground color or the mark color on the basis of the mark color, which is detected by the mark detecting unit at the time when the mark detecting unit is moved in a reverse direction for a distance of half the measurement value since the color detected is back to the ground color.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

According to the present embodiments, when the size of a selected positioning mark is too small or too large with respect to a detectable field of view of a mark detecting unit, a warning is issued. Therefore, when a portion of a business form selected as a positioning mark, such as a company name or logo, is inappropriate as a positioning mark, an operator can recognize this from the warning.

Other objects and features of the present invention will be revealed in the following description of the embodiments with reference to the accompanying drawings.

First Embodiment

Figure 1:
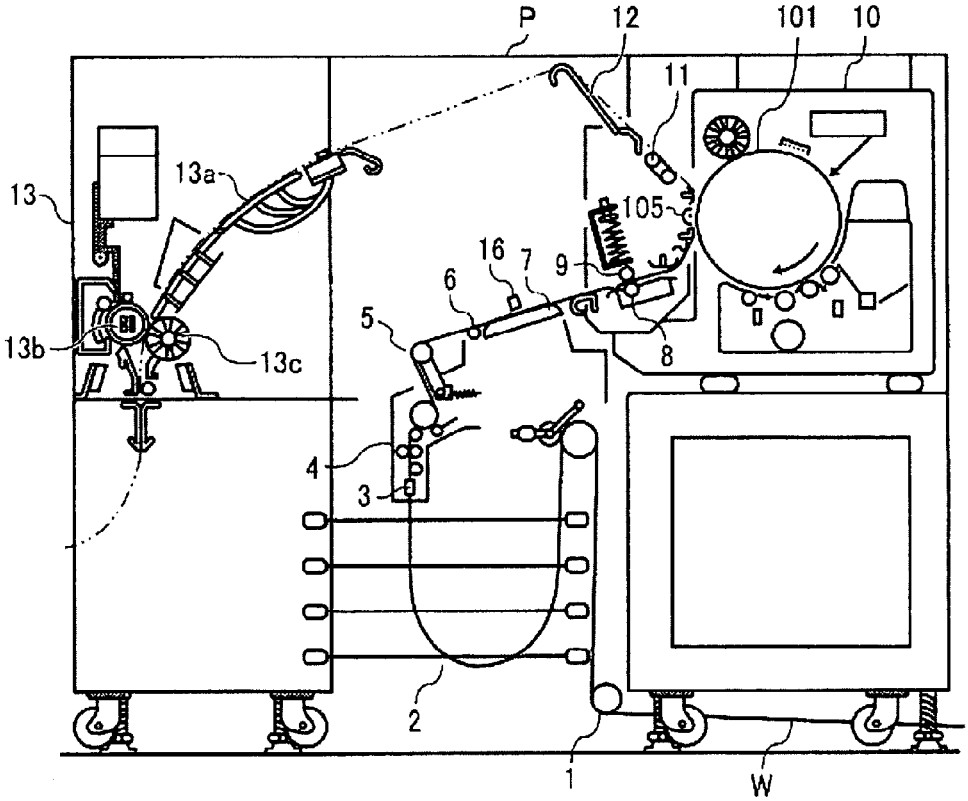
FIG.1 Conventional Art
FIG. 1 is a longitudinal sectional view illustrating an outline of a structure of a printing device embodying one aspect of the present invention.
Figure 2:
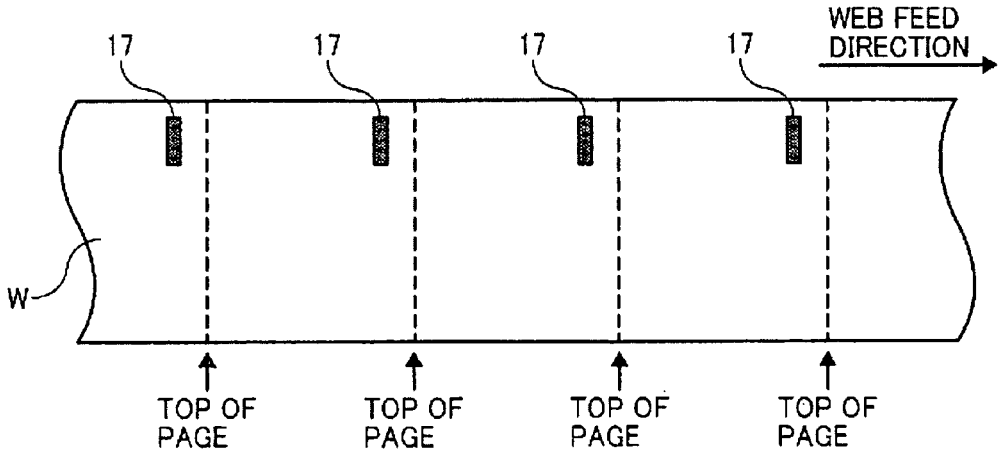
FIG.2 Conventional Art
FIG. 2 is a plan view of a web shown in FIG. 1, and illustrates an example of positioning marks formed on the web.
Figure 3:
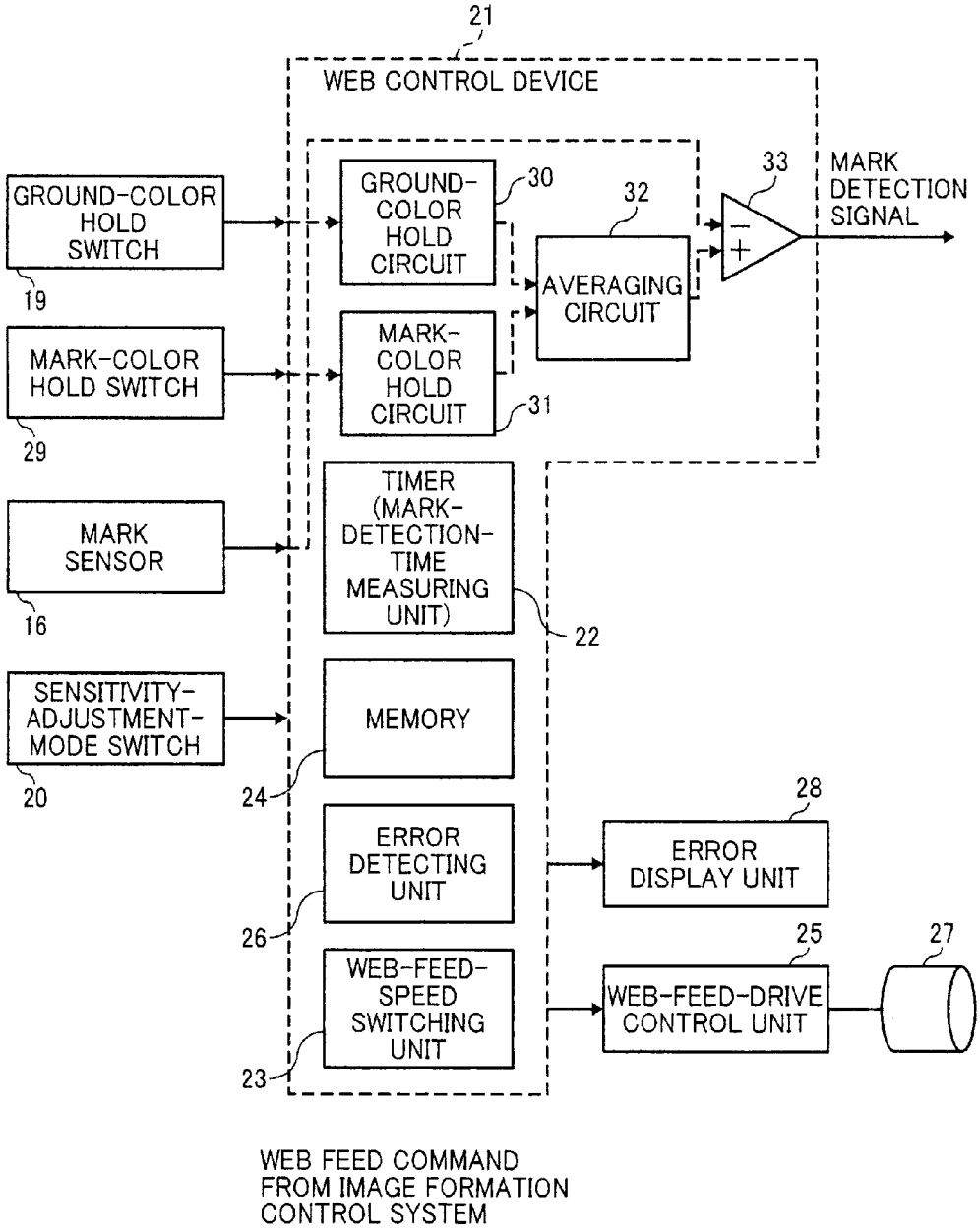
FIG. 3 is a block diagram illustrating a configuration and a function for detecting the positioning mark, which are included in the printing device shown in FIG. 1.

An image forming apparatus according to a first embodiment has the same device configuration as that of the conventional image forming apparatus described above with reference to FIGS. 1 and 2. FIG. 3 shows an outline of a web control device 21 included in the image forming apparatus. The web control device 21 embodies one aspect of the present invention. In FIG. 3, a mark sensor 16 as a mark detecting unit is a sensitivity-adjustable optical sensor composed of a light-emitting element and a light-sensitive element.

In a sensitivity adjustment, the mark sensor 16 detects a color of a positioning mark 17 that one wants to detect and a ground color of a web W, and an intermediate level of color levels of the two colors is set as a threshold. In the present embodiment, a sensor output after the sensitivity adjustment is an L level when the positioning mark 17 is detected and an H level when the ground color of the web W is detected, and an L-level sensor output is a mark detection signal. In image formation, this sensor output is subjected to waveform shaping and then given as a mark detection signal (a page timing signal) to an image formation control system.

To make the sensitivity adjustment, the web control device 21 includes a ground-color hold circuit 30, a mark-color hold circuit 31, an averaging circuit 32, and a comparison circuit 33. The ground-color hold circuit 30 holds a detection signal of the mark sensor 16 at the time when a ground-color hold switch 19 is pressed. The mark-color hold circuit 31 holds a detection signal of the mark sensor 16 at the time when a mark-color hold switch 29 is pressed. The averaging circuit 32 outputs a threshold level which is an intermediate-level (average-level) signal of hold signal levels of the hold circuits 30 and 31. The comparison circuit 33 generates an H-level (ground color) binary signal (mark detection pulse) from a detection signal of the mark sensor 16 if a level of the detection signal of the mark sensor 16 is equal to or higher than the threshold level; the comparison circuit 33 generates an L-level (mark) binary signal from a detection signal of the mark sensor 16 if a level of the detection signal of the mark sensor 16 is lower than the threshold level. Incidentally, as another form, the hold circuits 30 and 31 can be replaced by an A/D converter and a memory (a register), and the averaging circuit 32 can be replaced by an average-value calculating circuit and a D/A converter. Furthermore, as still another form, not the web control device 21 but the mark sensor 16 can include functions of the hold circuits 30 and 31, the averaging circuit 32, and the comparison circuit 33.

A sensitivity-adjustment-mode switch 20 is a switch for selectively specifying either a sensitivity adjustment mode in which the positioning mark 17 is arranged in the center of a detectable area ϕ of the mark sensor 16, or a check mode in which a warning to an operator to change the positioning mark 17 is issued if the positioning mark 17 is small. A timer 22 measures a mark detection time of a mark detection signal output from the mark sensor 16. A memory 24 is a memory for storing therein a measurement result of the mark detection time. A web-feed-speed switching unit 23 switches the web feed speed to a speed V1 when the sensitivity adjustment mode or the check mode is selected. When an imaging unit 10 forms an image on a web W, the web feed speed is switched to a speed according to a web feed command from the image formation control system (not shown). A web-feed-drive control unit 25 controls forward rotation, stoppage, and reverse rotation of a feed-roller driving motor 27 for driving web feed rollers 8 and 9 shown in FIG. 1 to rotate and also controls the driving speed of the feed-roller driving motor 27. An error detecting unit 26 detects an error if a mark detection time is shorter than a prescribed value. An error display unit 28 warns an operator to change the positioning mark 17 in response to detection of the error.

Figure 5:
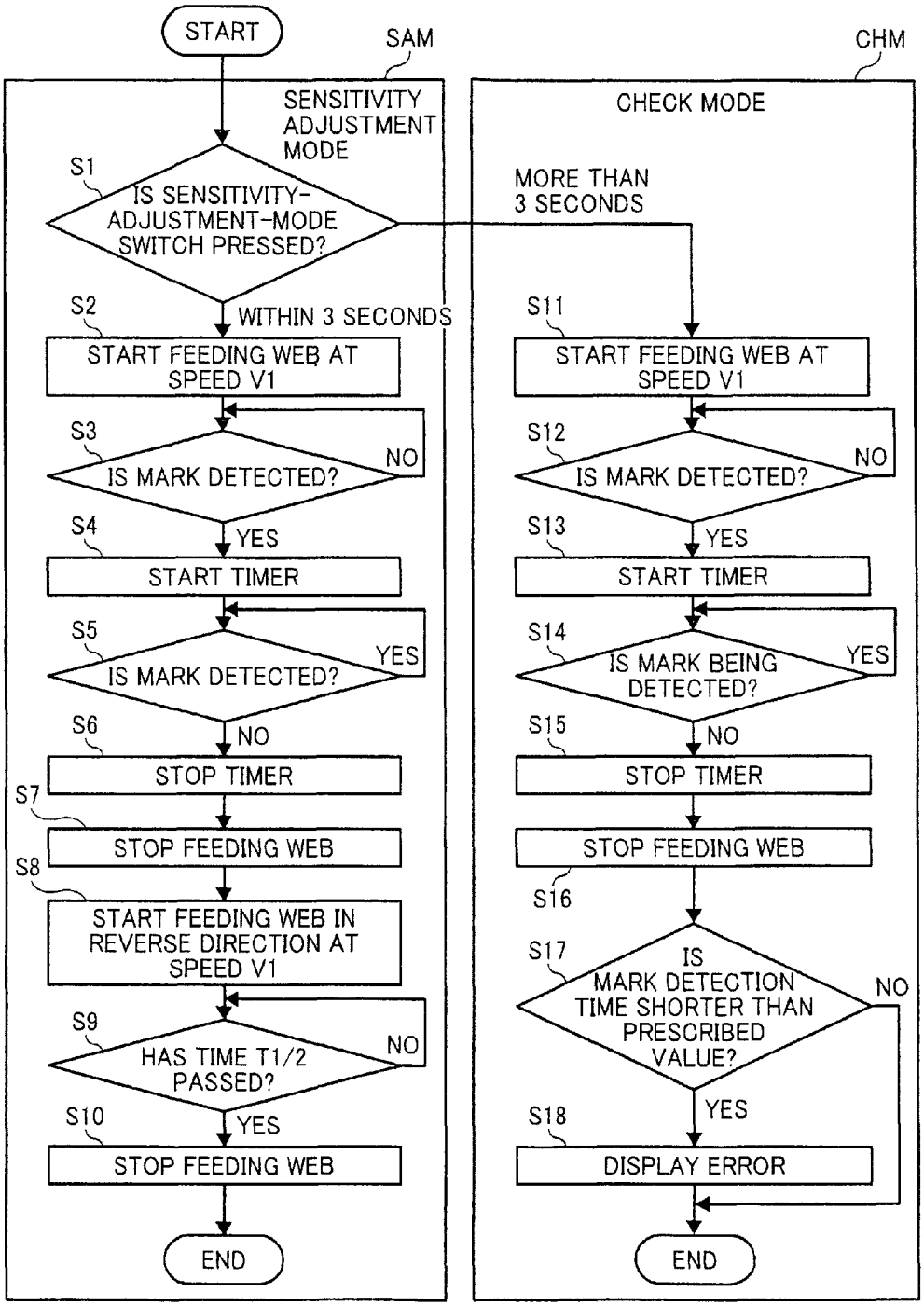
FIG. 5 is a flowchart illustrating contents of a sensitivity adjustment mode and a check mode according to a first embodiment of the present invention using the configuration and the function for detecting the positioning mark shown in FIG. 3.
Figure 8:
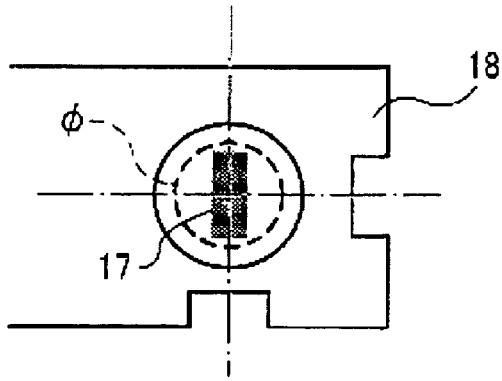
FIG.8 Conventional Art
FIG. 8 is a plan view illustrating a scale used to set a mark position as a preliminary preparation at the time of sensitivity adjustment.
Figure 9A:
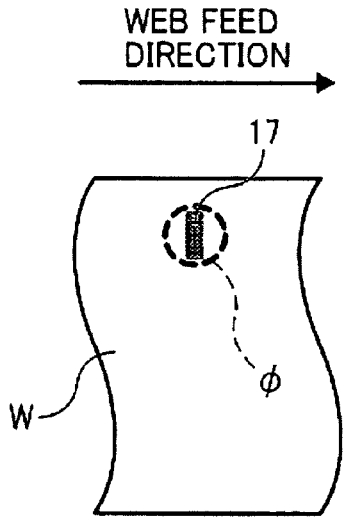
FIG.9A Conventional Art
FIGS. 9A and 9B are plan views illustrating two examples of the relative position of the positioning mark to the detectable area of the mark detecting unit.
Figure 9B:
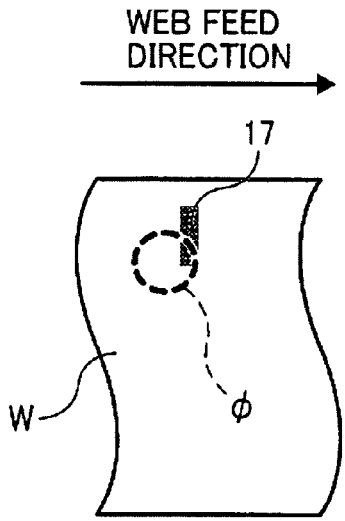
FIG.9B Conventional Art
Figure 10:
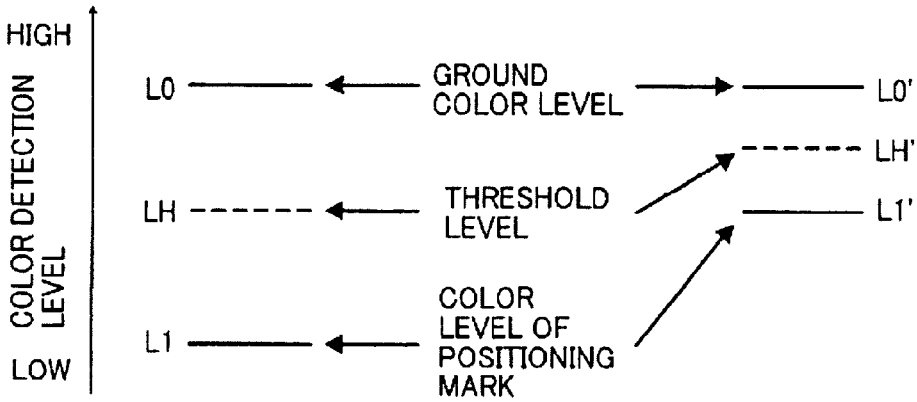
FIG.10 Conventional Art
FIG. 10 is a plan view showing a level of a detection signal of the mark sensor and a set threshold level.

FIG. 5 shows outlines of a sensitivity adjustment and a sensitivity check made by the web control device 21. The sensitivity adjustment mode is a mode in which the positioning mark 17 is arranged in the center of the detectable area ϕ of the mark sensor 16 on the basis of an output signal of the mark sensor 16; as described above, to cause the mark sensor 16 to recognize the positioning mark 17, it is necessary to set an appropriate threshold in advance. Therefore, as a preliminary preparation for the transition to the sensitivity adjustment mode, a coarse adjustment of the sensitivity using a scale 18 as shown in FIG. 8 is made. This is for roughly adjusting the sensitivity of the mark sensor 16 in accordance with the colors of the positioning mark 17 and the web W. In the coarse adjustment, the web W is moved so that a whole field of view of the mark sensor 16 is made up of only the ground color portion, and the ground-color hold switch 19 is pressed thereby causing the ground-color hold circuit 30 to hold (memorize) a ground-color detection signal (voltage level) of the mark sensor 16; then, the web W is moved so that the positioning mark 17 is positioned roughly in the center of the field of view of the mark sensor 16, and the mark-color hold switch 29 is pressed thereby causing the mark-color hold circuit 31 to hold a mark-color detection signal (voltage level) of the mark sensor 16. This brings a threshold, an output of the averaging circuit 32, to an intermediate level TH" of the ground color level and the mark color level. Then, the web W is moved so that the positioning mark 17 is positioned on the downstream side of the mark sensor 16. The preliminary preparation for the sensitivity adjustment mode is completed.

Figure 4:
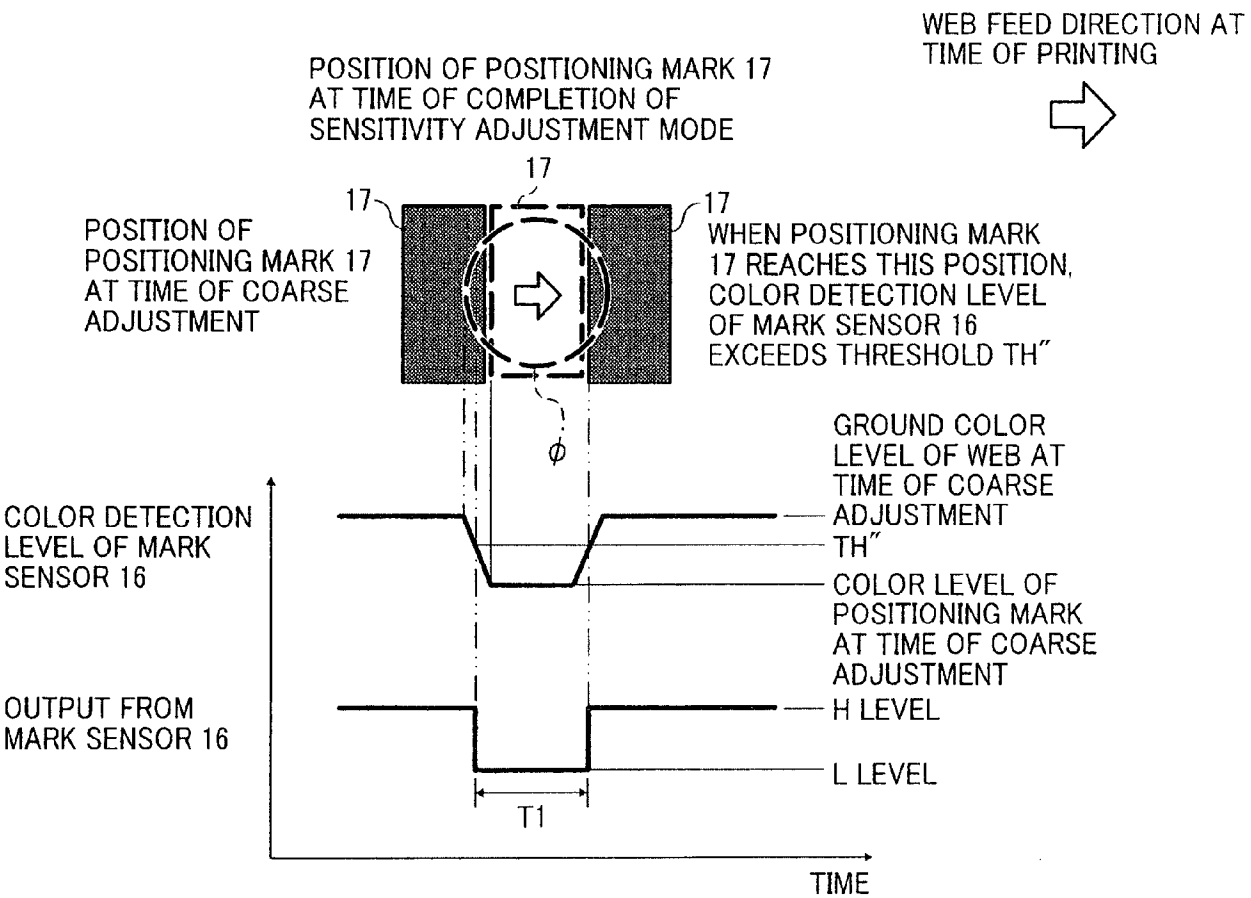
FIG. 4 is a graph showing a change in a color detection level of a mark sensor shown in FIG. 1 when the positioning mark passes through a mark detectable field of view of the mark sensor.

When the sensitivity-adjustment-mode switch 20 is pressed (turned on) and released from being held down within three seconds, an image forming system makes the transition to the sensitivity adjustment mode. Then, the web-feed-speed switching unit 23 sets the feed speed of the web W to the speed V1, and the feed of the web W is started, and then the mark sensor 16 starts detecting the positioning mark 17 (Steps S1 and S2). After that, when the positioning mark 17 formed on the web W reaches the detectable area ϕ of the mark sensor 16 and a color level detected by the mark sensor 16 falls below the threshold TH" set in the coarse adjustment, a mark detection signal changes from the H level to the L level, and the timer 22 starts measuring a mark detection time (Steps S3 and S4). When the web W is further fed, and the positioning mark 17 passes through the detectable area ϕ of the mark sensor 16, and then a color level detected by the mark sensor 16 exceeds the threshold TH", a mark detection signal changes from the L level to the H level. At this timing, the measurement of the mark detection time is stopped (Steps S5 and S6), and a measurement result T1 is stored in the memory 24, and then the feed of the web W is stopped (Step S7). After the feed of the web W is stopped, the web-feed-drive control unit 25 initiates the feed of the web W at the speed V1 in a reverse direction this time, and at a timing when a mark detection signal changes from the H level to the L level, the timer 22 starts measuring a mark detection time (Step S8). Then, when a measurement time of the timer 22 reaches a time T1/2, a mark detection signal of the mark sensor 16 is held in the mark-color hold circuit 31, i.e., the mark-color hold circuit 31 updates the mark detection signal to a mark detection signal of the mark sensor 16 at the time, and the web-feed-drive control unit 25 stops the feed of the web W (Steps S9 and S10). When the mark detection signal held in the mark-color hold circuit 31 is updated to a mark detection signal of the mark sensor 16 at the time, the averaging circuit 32 gives a threshold corresponding to the updated mark detection signal to the comparison circuit 33. At this time, the positioning mark 17 is positioned in the center of the sensor detectable area ϕ as shown in FIG. 4, so a contrast difference of the mark color with respect to the ground color of the web W is maximized.

That is the sensitivity adjustment mode. Incidentally, if the feed speed V1 of the web W is high speed, it may be difficult to position the positioning mark 17 in the center of the sensor detectable area ϕ. This is due to failing to correctly measure the measurement time T1 because the positioning mark 17 passes through the sensor detectable area ϕ while the feed speed of the web W is accelerated or due to a braking distance when the feed of the web W is stopped. Therefore, if the web feed speed at the time of image formation is high speed, it is preferable to set the speed V1 to a slower rate than that is at the time of image printing.

Subsequently, the check mode in which a warning to an operator to change the positioning mark 17 is issued is explained with reference to a flowchart shown in FIG. 5. When the sensitivity-adjustment-mode switch 20 is pressed and held down for a prescribed time or longer, for example, for more than three seconds, the check mode is started. In the check mode, in the same manner as in the sensitivity adjustment mode, the timer 22 measures a detection time of the positioning mark 17, and a measurement time t1 is stored in the memory 24 (Steps S11 to S16). Then, the error detecting unit 26 compares the measurement time t1 stored in the memory 24 with a preset criterion value (a set value) (Step S17). If the measurement time t1 is shorter than the criterion value, the error display unit 28 warns an operator to change the positioning mark 17 (Step S18).

Figure 7A:
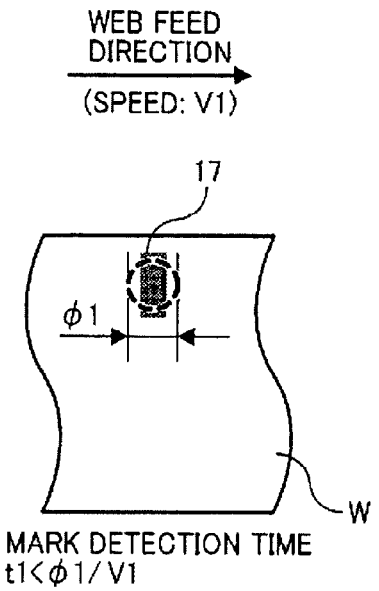
FIGS. 7A and 7B are plan views illustrating two examples of relative sizes of a detectable area of a mark detecting unit and the positioning mark.
Figure 7B:
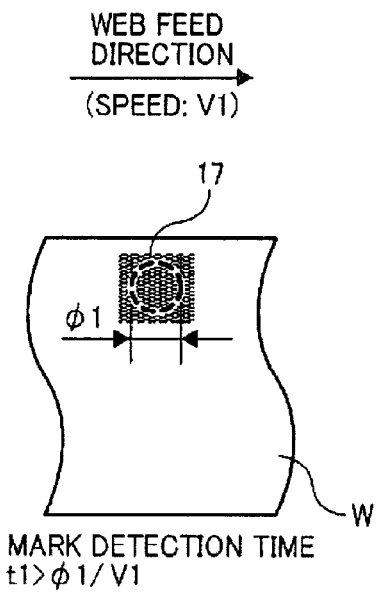

Here, the criterion value for determination of an error is explained with reference to FIGS. 7A and 7B. Here, a detectable area of the mark sensor 16 in the web feed direction is denoted by ϕ1, the feed speed of the web W is denoted by V1, and a measurement time of the positioning mark 17 is denoted by t1. If a length of the positioning mark 17 in the web feed direction is smaller than ϕ1 as shown in FIG. 7A, a relation of "t1<ϕ1/V1" holds true; if a length of the positioning mark 17 in the web feed direction is larger than ϕ1 as shown in FIG. 7B, a relation of "t1>ϕ1/V1" holds true. Therefore, for example, when the mark detection time t1 is in the relation of "t1<ϕ1/V1", a warning to an operator to change the positioning mark 17 is issued. Incidentally, if the present check mode is implemented after implementation of the sensitivity adjustment mode, a more highly accurate warning can be issued.

Second Embodiment

In a second embodiment, the image forming apparatus includes a main-scanning drive mechanism for moving the mark sensor 16 in a main-scanning direction perpendicular to a sub-scanning direction, i.e., a feed direction of the web W at the time of image formation. In the sensitivity adjustment mode, the positioning mark 17 is arranged in the center of the detectable area ϕ in the main-scanning direction on the basis of an output signal of the mark sensor 16. Namely, the mark sensor 16 is driven to move at a speed V2 in the main-scanning direction perpendicular to the feed direction of the web W at the time of image formation (the sub-scanning direction); when a color detected by the mark sensor 16 is switched from the color of the positioning mark 17 to the ground color in accordance with the movement of the mark sensor 16, the movement of the mark sensor 16 is stopped, and the mark sensor 16 is driven to move in the reverse direction at the speed V2; a time T2, which is from when a color detected by the mark detecting unit is switched from the ground color to the color of the positioning mark 17 in accordance with the movement of the mark sensor 16 till when a color detected by the mark detecting unit is back to the ground color, is measured; when a color detected by the mark sensor 16 is back to the ground color, the mark sensor 16 is driven to move at the speed V2 in the reverse direction; when a time T2/2 has passed since a color detected by the mark sensor 16 is switched from the ground color to the color of the positioning mark 17 in accordance with the movement of the mark sensor 16, the movement of the mark sensor 16 is stopped, and a color detected by the mark sensor 16 at the time, i.e., the mark color is used for setting of a threshold.

Also in the second embodiment, as a preliminary preparation for the transition to the sensitivity adjustment mode, a coarse adjustment of the sensitivity using the scale 18 as shown in FIG. 8 is made. This is for roughly adjusting the sensitivity of the mark sensor 16 in accordance with the colors of the positioning mark 17 and the web W. In the coarse adjustment, the web W is moved in the sub-scanning direction so that a whole field of view of the mark sensor 16 is made up of only the ground color portion, and the ground-color hold switch 19 is pressed thereby causing the ground-color hold circuit 30 to hold (memorize) a ground-color detection signal (voltage level) of the mark sensor 16; then, the web W is moved in the sub-scanning direction and the mark sensor 16 is moved in the main-scanning direction so that the positioning mark 17 is positioned roughly in the center of the field of view of the mark sensor 16, and the mark-color hold switch 29 is pressed thereby causing the mark-color hold circuit 31 to hold a mark-color detection signal (voltage level) of the mark sensor 16. This brings a threshold, an output of the averaging circuit 32, to an intermediate level TH" of the ground color level and the mark color level. Then, the mark sensor 16 is moved in the main-scanning direction so that the mark sensor 16 is positioned on the upstream side of the positioning mark 17. The preliminary preparation for the sensitivity adjustment mode is completed.

When the sensitivity-adjustment-mode switch 20 is pressed (turned on) and released from being held down within three seconds, the image forming system makes the transition to the sensitivity adjustment mode. Then, a sensor drive circuit starts driving the mark sensor 16 to move at the speed V2 in a forth direction toward the positioning mark 17, and the mark sensor 16 starts detecting the positioning mark 17. After that, when the detectable area ϕ of the mark sensor 16 reaches the positioning mark 17 on the web W and a color level detected by the mark sensor 16 falls below the threshold TH" set in the coarse adjustment, a mark detection signal changes from the H level to the L level and the timer 22 starts measuring a mark detection time. When the sensor drive circuit further drives the mark sensor 16 to move in the main-scanning direction, and the detectable area ϕ of the mark sensor 16 passes through the positioning mark 17, and then a color level detected by the mark sensor 16 exceeds the threshold TH", a mark detection signal changes from the L level to the H level. At this timing, the measurement of the mark detection time T2 is stopped, and a measurement result T2 is stored in the memory 24, and then the movement of the mark sensor 16 in the main-scanning direction is stopped. After the movement of the mark sensor 16 is stopped, the mark sensor 16 is driven to move in a back direction of the main-scanning direction this time, and at a timing when a mark detection signal changes from the H level to the L level, the timer 22 starts measuring a mark detection time. Then, when a measurement time of the timer 22 reaches a time T2/2, a mark detection signal of the mark sensor 16 is held in the mark-color hold circuit 31, i.e., the mark-color hold circuit 31 updates the mark detection signal to a mark detection signal of the time, and the movement of the mark sensor 16 in the main-scanning direction is stopped. When the mark detection signal held in the mark-color hold circuit 31 is updated to a mark detection signal of the mark sensor 16 at the time, the averaging circuit 32 gives a threshold corresponding to the updated mark detection signal to the comparison circuit 33. At this time, the positioning mark 17 is positioned in the center of the sensor detectable area ϕ in the main-scanning direction as shown in FIG. 4, so a contrast difference of the mark color with respect to the ground color of the web W is maximized.

That is the sensitivity adjustment mode. The check mode, in which a warning to an operator to change the positioning mark 17 is issued, is started when the sensitivity-adjustment-mode switch 20 is pressed and held down for a prescribed time or longer, for example, for more than three seconds. In the check mode, in the same manner as in the sensitivity adjustment mode, the timer 22 measures a detection time of the positioning mark 17, and a measurement time t2 is stored in the memory 24. Then, the error detecting unit 26 compares the measurement time t2 stored in the memory 24 with a preset criterion value (a set value). If the measurement time t2 is shorter than the criterion value, the error display unit 28 warns an operator to change the positioning mark 17. Here, a detectable area of the mark sensor 16 in the web feed direction is denoted by ϕ1, the main-scanning-direction moving speed of the mark sensor 16 is denoted by V2, and a measurement time of the positioning mark 17 is denoted by t2. If a width of the positioning mark 17 in the main-scanning direction is smaller than ϕ1, a relation of "t2<ϕ1/V2" holds true; if a width of the positioning mark 17 in the main-scanning direction is larger than ϕ1, a relation of "t2>ϕ1/V2" holds true. Therefore, for example, when the mark detection time t2 is in the relation of "t2<ϕ1/V2", a warning to an operator to change the positioning mark 17 is issued. Incidentally, if the present check mode is implemented after implementation of the sensitivity adjustment mode, a more highly accurate warning can be issued. The other configurations and functions in the second embodiment are identical to those in the first embodiment.

Third Embodiment

In a third embodiment, the positioning mark 17 is positioned in the center of a viewing field area ϕ of the mark sensor 16 in the sub-scanning direction in the same manner as in the first embodiment, and then the mark sensor 16 is positioned in the center of the viewing field area ϕ in the main-scanning direction in the same manner as in the second embodiment, and then a detected color signal of the mark sensor 16 at the time is held in the mark-color hold circuit 31, and the mark sensor 16 is kept at the position (a main-scanning-direction optimum position). Namely, in the third embodiment, the web W is driven to move at the speed V1; a time T1, which is from when a color detected by the mark sensor 16 is switched from the ground color to the color of the positioning mark 17 in accordance with the movement of the web W till when a color detected by the mark sensor 16 is back to the ground color, is measured; when a color detected by the mark sensor 16 is back to the ground color, the web W is driven to move in the reverse direction at the speed V1; when a time T1/2 has passed since a color detected by the mark sensor 16 is switched from the ground color to the color of the positioning mark 17 in accordance with the movement of the web W, the movement of the web W is stopped, and the mark sensor 16 is driven to move in the main-scanning direction perpendicular to the feed direction of the web W (the sub-scanning direction); when a color detected by the mark sensor 16 is switched from the color of the positioning mark 17 to the ground color in accordance with the movement of the mark sensor 16, the movement of the mark sensor 16 is stopped, and the mark sensor 16 is driven to move in the reverse direction at the speed V2; a time T2, which is from when a color detected by the mark sensor 16 is switched from the ground color to the color of the positioning mark 17 in accordance with the movement of the mark sensor 16 till when a color detected by the mark sensor 16 is back to the ground color, is measured; when a color detected by the mark sensor 16 is back to the ground color, the mark sensor 16 is driven to move in the reverse direction at the speed V2; when a time T2/2 has passed since a color detected by the mark sensor 16 is switched from the ground color to the color of the positioning mark 17 in accordance with the movement of the mark sensor 16, the movement of the mark sensor 16 is stopped, and a color detected by the mark sensor 16 at the time, i.e., the mark color is used for setting of a threshold; the mark sensor 16 is kept at the position, and used for detection of the subsequent positioning mark 17.

Figure 6:
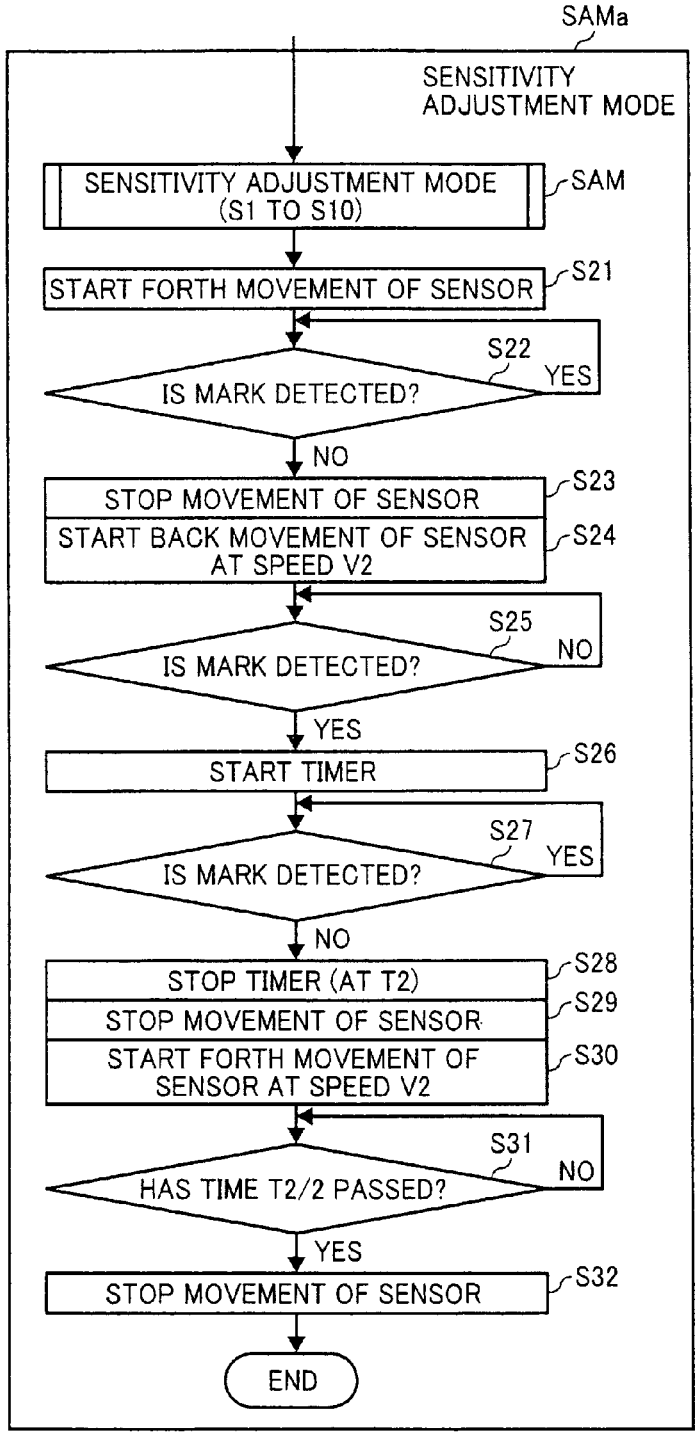
FIG. 6 is a flowchart illustrating contents of a sensitivity adjustment mode according to a third embodiment of the present invention.

FIG. 6 shows contents of SAMa, the "sensitivity adjustment mode" according to the third embodiment. In this "sensitivity adjustment mode" SAMa, first, the sensitivity adjustment mode SAM according to the first embodiment (Steps S1 to S10) is executed, and the positioning mark 17 on the web W is positioned in the center of the viewing field area ϕ of the mark sensor 16 in the sub-scanning direction; then, in the same manner as the sensitivity adjustment mode according to the second embodiment, the mark sensor 16 is driven to move in the main-scanning direction perpendicular to the feed direction of the web W (the sub-scanning direction); when a color detected by the mark sensor 16 is switched from the color of the positioning mark 17 to the ground color, the movement of the mark sensor 16 is stopped, and the mark sensor 16 is driven to move at the speed V2 in the reverse direction; a time T2, which is from when a color detected by the mark sensor 16 is switched from the ground color to the color of the positioning mark 17 till when a color detected by the mark sensor 16 is back to the ground color, is measured; when a color detected by the mark sensor 16 is back to the ground color, the mark sensor 16 is driven to move at the speed V2 in the reverse direction; when a time T2/2 has passed since a color detected by the mark sensor 16 is switched from the ground color to the color of the positioning mark 17, the movement of the mark sensor 16 is stopped, and a color detected by the mark sensor 16 at the time, i.e., the mark color is used for setting of a threshold (Steps S21 to S32); the mark sensor 16 is kept at the position, and used for detection of the subsequent positioning mark 17.

In the check mode according to the third embodiment in which a warning to an operator to change the positioning mark 17 is issued, whether the measurement times T1 and T2 are within respective setting ranges is determined, and an operator is informed of an error if the measurement times T1 and T2 are out of the setting ranges. If the check mode is implemented after implementation of the sensitivity adjustment mode, a more highly accurate warning can be issued. The other configurations and functions in the third embodiment are identical to those in the first embodiment.

Fourth Embodiment

In a fourth embodiment, moving amounts P1 (corresponding to a moving amount in the time T1) and p1 (corresponding to a moving amount in the time t1) of the web W are measured instead of measurements of the times T1 and t1 made in the first embodiment. To transfer a toner image formed on the photosensitive drum 101 of the imaging unit 10 onto a predetermined position of the web W based on the positioning mark 17 formed on the web W, the image forming apparatus (FIG. 1) produces one feed synchronization pulse (timing pulse) with each movement of a predetermined short distance of the web W in synchronization with the feed of the web W. Then, the image forming apparatus starts counting the number of the feed synchronization pulses (measuring a moving amount of the web W) each time the mark sensor 16 detects the positioning mark 17, and the count value is referenced in the image formation control. In the fourth embodiment, the moving amounts P1 and p1 are measured by counting the number of the feed synchronization pulses. Then, in the fourth embodiment, a moving amount P1 of the web W in a time from when a color detected by the mark sensor 16 is switched from the ground color to the color of the positioning mark 17 in accordance with the movement of the web W till when a color detected by the mark sensor 16 is back to the ground color is measured; when a color detected by the mark sensor 16 is back to the ground color, the web W is driven to move in the reverse direction; a color detected by the mark sensor 16 at the time when a moving amount of the web W since a color detected by the mark sensor 16 is switched from the ground color to the color of the positioning mark 17 is P1/2, i.e., the mark color is used for setting of a threshold. The other configurations and functions are identical to those in the first embodiment.

Fifth Embodiment

In a fifth embodiment, moving amounts P2 (corresponding to a moving amount in the time T2) and p2 (corresponding to a moving amount in the time t2) of the mark sensor 16 in the main-scanning direction are measured instead of measurements of the times T2 and t2 made in the second embodiment. Namely, in the fifth embodiment, an encoder is installed on a drive shaft of the main-scanning drive mechanism described in the second embodiment; the mark sensor 16 is driven to move in the main-scanning direction, and moving amounts P2 and p2 of the mark sensor 16 in the main-scanning direction are measured by counting the number of pulse signals generated by the encoder. A count value, i.e., a moving amount P2 of the mark sensor 16 in a time from when a color detected by the mark sensor 16 is switched from the ground color to the color of the positioning mark 17 in accordance with the movement of the mark sensor 16 till when a color detected by the mark sensor 16 is back to the ground color is measured; when a color detected by the mark sensor 16 is back to the ground color, the mark sensor 16 is driven to move in the reverse direction; a color detected by the mark sensor 16 at the time when a moving amount of the mark sensor 16 since a color detected by the mark sensor 16 is switched from the ground color to the color of the positioning mark 17 is P2/2, i.e., the mark color is used for setting of a threshold. The other configurations and functions are identical to those in the second embodiment.

Sixth Embodiment

In a sixth embodiment, the positioning mark 17 is positioned in the center of the viewing field area ϕ of the mark sensor 16 in the sub-scanning direction in the same manner as in the fourth embodiment, and then the mark sensor 16 is positioned in the center of the viewing field area ϕ in the main-scanning direction in the same manner as in the fifth embodiment, and a detected color signal of the mark sensor 16 at the time is held in the mark-color hold circuit 31, and the mark sensor 16 is kept at the position (the main-scanning-direction optimum position). Namely, in the sixth embodiment, the web W is driven to move, and a moving amount P1 of the web W in a time from when a color detected by the mark sensor 16 is switched from the ground color to the color of the positioning mark 17 in accordance with the movement of the web W till when a color detected by the mark sensor 16 is back to the ground color is measured; when a color detected by the mark sensor 16 is back to the ground color, the web W is driven to move in the reverse direction; when a moving amount of the web W since a color detected by the mark sensor 16 is switched from the ground color to the color of the positioning mark 17 is P1/2, the movement of the web W is stopped, and the mark sensor 16 is driven to move in the main-scanning direction perpendicular to the feed direction of the web W (the sub-scanning direction); when a color detected by the mark sensor 16 is switched from the color of the positioning mark 17 to the ground color in accordance with the movement of the mark sensor 16, the movement of the mark sensor 16 is stopped, and the mark sensor 16 is driven to move in the reverse direction; a moving amount P2 of the mark sensor 16 in the main-scanning direction in a time from when a color detected by the mark sensor 16 is switched from the ground color to the color of the positioning mark 17 in accordance with the movement of the mark sensor 16 till when a color detected by the mark sensor 16 is back to the ground color is measured; when a color detected by the mark sensor 16 is back to the ground color, the mark sensor 16 is driven to move in the reverse direction; when the mark sensor 16 is moved for a distance P2/2 since a color detected by the mark sensor 16 is switched from the ground color to the color of the positioning mark 17, the movement of the mark sensor 16 is stopped, and a color detected by the mark sensor 16 at the time, i.e., the mark color is used for setting of a threshold; the mark sensor 16 is kept at the position, and used for detection of the subsequent positioning mark 17.

According to the present invention, a positioning mark is set in the center of a detectable area of a mark detecting unit, a color of the positioning mark is detected, and the detected color is used for setting of a threshold; therefore, a contrast difference between the color of the positioning mark and a ground color of a web is maximized. Consequently, even if a disturbance, such as flapping of the web, is produced while the web is fed, there is no false detection of the positioning mark.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that forms an image on a web with reference to a position of a positioning mark on the web, the image forming apparatus comprising:

a moving unit that causes a relative movement of the web and a mark detecting unit in a predetermined direction, the mark detecting unit detecting a ground color of the web and a mark color which is a color of the positioning mark; and a control device that measures a measurement value corresponding to a moving amount of the mark detecting unit with respect to the web in a forward direction in a time from when a color detected by the mark detecting unit is switched from the ground color to the mark color till when a color detected by the mark detecting unit is switched back to the ground color, wherein the control device causes the moving unit to relatively move the web and the mark detecting unit in a reverse direction for a distance of half the measurement value from when the color detected is switched back to the ground color and measures a mark detection signal that is detected by the mark detecting unit at this distance, and wherein the control device sets a threshold used for determining whether the color detected is the ground color or the mark color on the basis of the measured mark detection signal.

2. The image forming apparatus according to claim 1, wherein the moving unit moves the web in a sub-scanning direction, which indicates a feed direction of the web at the time of image formation.

3. The image forming apparatus according to claim 2, wherein the moving unit further moves the mark detecting unit in a main-scanning direction perpendicular to the sub-scanning direction, the measurement value measured by the control device comprises a first measurement value corresponding to a moving amount of the mark detecting unit with respect to the web in a time from when the color detected is switched from the ground color to the mark color in accordance with movement of the web in the sub-scanning direction till when the color detected is switched back to the ground color, and a second measurement value corresponding to a moving amount of the mark detecting unit with respect to the web in a time from when the color detected is switched from the ground color to the mark color in accordance with movement of the mark detecting unit in the main-scanning direction till when the color detected is switched back to the ground color, the control device causes the moving unit to relatively move the web and the mark detecting unit in the reverse direction for a distance of half the measurement value from when the color detected is switched back to the ground color in accordance with the movement of the web in the sub-scanning and the movement of the mark detecting unit in the main-scanning direction and measures the mark detection signal at this distance, and the control device sets the threshold on the basis of the measured mark detection signal.

4. The image forming apparatus according to claim 1, wherein the moving unit moves the mark detecting unit in a main-scanning direction perpendicular to a sub-scanning direction, which indicates a feed direction of the web at the time of image formation.

5. The image forming apparatus according to claim 1, wherein the moving unit causes a relative movement of the web and the mark detecting unit in a predetermined direction at a predetermined speed, the measurement value corresponds to a detection time from when the color detected is switched from the ground color to the mark color in accordance with movement at the predetermined speed till when the color detected is switched back to the ground color, and the control device causes the moving unit to relatively move the web and the mark detecting unit in the reverse direction for a time of half the detection time from when the color detected is switched back to the ground color and measures the mark detection signal at this time.

6. The image forming apparatus according to claim 5, wherein the moving unit moves the web in a sub-scanning direction, which indicates a feed direction of the web at the time of image formation, at the predetermined speed lower than a feed speed of the web at the time of image formation.

7. The image forming apparatus according to claim 1, wherein the measurement value corresponds to a count value of a number of pulse signals depending on the moving amount of the mark detecting unit with respect to the web in the time from when the color detected is switched from the ground color to the mark color till when the color detected is switched back to the ground color, and the control device causes the moving unit to relatively move the web and the mark detecting unit in the reverse direction for a distance corresponding to a half of the count value from when the color detected is switched back to the ground color and measures the mark detection signal at this distance.

8. The image forming apparatus according to claim 1, further comprising an error detecting unit that compares the measurement value with a predetermined criterion value and outputs an error message if the measurement value is smaller than the criterion value.

9. A threshold setting method executed in an image forming apparatus for forming an image on a web with reference to a position of a positioning mark on the web, the threshold setting method comprising:

causing, by a moving unit, a relative movement of the web and a mark detecting unit, which detects a ground color of the web and a mark color that is a color of the positioning mark, in a predetermined direction;

measuring, by a control device, a measurement value corresponding to a moving amount of the mark detecting unit with respect to the web in a forward direction in a time from when a color detected by the mark detecting unit is switched from the ground color to the mark color till when a color detected by the mark detecting unit is switched back to the ground color;

causing, by the control device, the moving unit to relatively move the web and the mark detecting unit in a reverse direction for a distance of half the measurement value from when the color detected is switched back to the ground color and measuring, by the control device, a mark detection signal that is detected by the mark detecting unit at this distance, and setting, by the control device, a threshold used for determining whether the color detected is the ground color or the mark color on the basis of the measured mark detection signal.

* * * * *